US009039892B2

(12) United States Patent
Hussain et al.

(10) Patent No.: US 9,039,892 B2
(45) Date of Patent: May 26, 2015

(54) NANO CATALYTIC DEWAXING OF HEAVY PETROLEUM WASTES (>C-23 ALKANES)

(76) Inventors: Syed Tajammul Hussain, Islamabad (PK); Mehmood Ahmed, Karachi (PK)

( * ) Notice: Subject to any disclaimer, the term of this patent is extended or adjusted under 35 U.S.C. 154(b) by 352 days.

(21) Appl. No.: 13/603,662

(22) Filed: Sep. 5, 2012

(65) Prior Publication Data

US 2014/0061099 A1 Mar. 6, 2014

(51) Int. Cl.
*C10G 45/00* (2006.01)
*C10G 45/64* (2006.01)

(52) U.S. Cl.
CPC ..... *C10G 45/64* (2013.01); *C10G 2300/1022* (2013.01)

(58) Field of Classification Search
CPC ..... C10G 45/62; C10G 45/64; C10G 2300/1022; B01J 21/08; B01J 23/28; B01J 23/74; B01J 23/75; B01J 23/755; B01J 23/76; B01J 23/84; B01J 23/881; B01J 23/882
USPC ..... 208/264, 295, 300; 502/74, 232, 233, 502/237, 255, 257, 259, 260
See application file for complete search history.

(56) References Cited

U.S. PATENT DOCUMENTS 3,700,585 A 10/1972 Chen et al.
3,894,938 A 7/1975 Gorring et al.
3,933,974 A 1/1976 Winquist
4,176,050 A 11/1979 Chen et al.
4,181,598 A 1/1980 Gillespie et al.
4,222,855 A 9/1980 Pelrine et al.
4,229,282 A 10/1980 Peters et al.
4,247,388 A 1/1981 Banta et al.
4,252,499 A 2/1981 Erickson
4,259,170 A 3/1981 Graham et al.
4,259,174 A 3/1981 Chen et al.
4,508,836 A 4/1985 Haag et al.
4,683,052 A 7/1987 Degnan, Jr. et al.
8,216,961 B2 * 7/2012 Lee ..... 502/240
2009/0057201 A1 * 3/2009 Brait et al. ..... 208/143

FOREIGN PATENT DOCUMENTS

EP 225053 6/1987

OTHER PUBLICATIONS

Chen at al., "Industrial Application of Shape Selective Catalysis," Catal. Rev. Sci. Eng. 28(283), pp. 185-264 (1986).

* cited by examiner

*Primary Examiner* — Randy Boyer
*Assistant Examiner* — Juan Valencia
(74) *Attorney, Agent, or Firm* — Sarfaraz Niazi

(57) ABSTRACT

A catalyst comprising of nano nickel-silica catalyst for dewaxing of heavy petroleum feed at a temperature 200-350° C. at 8 bar and 30 bar hydrogen pressure and in the presence of hydrogen is designed for petrochemical industries. According to a specific aspect of the invention, the nano catalyst is designed and employed to convert heavy hydrocarbon feeds of high viscosity index to low pour point and good stability in a single step.

12 Claims, 13 Drawing Sheets

Schematic representation of hydrogen ion replacement by ammonium ions

NANO CATALYTIC DEWAXING OF HEAVY PETROLEUM WASTES (>C-23 ALKANES)

FIELD OF INVENTION

This invention relates to the highly selective catalyst for catalytic dewaxing of heavy petroleum products (>C-23). In this de-waxing process catalyst aging is retarded and by converting into nano particles large surface area and more than 90% active catalytic sites becomes available for the process. The catalyst tolerance to sulfur and nitrogen containing compounds is also significantly improved.

BACKGROUND OF INVENTION

Processes for dewaxing petroleum distillates are well known. Dewaxing is required when highly paraffin oils are to be used in products which must be mobile at low temperature. The high molecular weight straight chain normal and branched parrfains present in such oil are waxes which cause high pour points and high cloud points in the oils. If adequately low pour points are to be obtained, the waxes must be wholly or partially removed.

A number of dewaxing processes is known in the petroleum refining industry. The catalyst which have been proposed for the dewaxing processes have usually been zeolite which have a pore size which admits the straight chain, waxy n-parrafins but which exclude more highly branched chain materials and cycloadditions. Intermediate pore size zeolites such as ZSM-5, ZSM-11, ZSM-12, ZSM-23, ZSM-35, ZSM-38 and the synthetic ferrierites have been proposed for this purpose in dewaxing processes, as described in U.S. Pat. No. 3,700,585 (Re 28398); U.S. Pat. Nos. 3,894,938; 3,933,974; 4,176,050; 4,181,598; 4,222,855; 4,259,170; 4,229,282; 4,252,499; and 4.247,388.

A dewaxing process employing synthetic offretite is described in U.S. Pat. No. 4,259,174. The Mobil Lube Dewaxing Process (MLDW) is also described in Chen et al "Industrial Application of Shape Selective Catalysis" Catal. Rev.-Sci. Eng. 28 (283), 185-264 (1986) especially pp. 241-247, to which reference is made for a further description of process. Reference is made to these disclosures for a description of various catalytic dewaxing processes.

In catalytic dewaxing processes of this kind, the catalyst becomes progressively deactivated as the dewaxing cycle progresses. To compensate this, the temperature of the dewaxing reactor is progressively raised in order to meet the target pour point of the products. There is a limit, however, to which the temperature can be raised before the properties of the product, especially oxidation stability become unacceptable. For this reason, the catalytic dewaxing process is usually operated in cycles with the temperature being raised in the course of the cycle from a low start of cycle (SOC) value, typically about 260° C., to a final, end of cycle (EOC) value, typically about 360°, after which the catalyst is reactivated or regenerated for a new cycle.

The use of a metal hydrogenation component on the dewaxing catalyst has been described as a highly desirable expedient, both for obtaining extended dewaxing cycle durations and for improving the reactivation. U.S. Pat. No. 4,683,052 discloses the use of noble metals component e.g., Pt, Pd as a superior metals such as nickel for this purpose. During the dewaxing cycle itself, nickel on catalyst was thought to reduce the extent of coke lay down by promoting transfer of hydrogen to coke precursors formed on the catalyst during dewaxing reactions. Similarly, the metal was also thought to promote removal of coke and coke precursors during hydrogen reactivation by promoting hydrogen transfer to these species to form materials which could be more readily desorbed from the catalyst.

European Patent Application No. 225,053 discloses a process for producing lubricant oils by partially dewaxing a lubricant base stock by isomerization dewaxing step carried out using a large pore high silica zeolite dewaxing catalyst such as silica Y or zeolite beta which isomerizes the waxy components of the base stock to less waxy branched chain isoparaffins. The selective dewaxing step may be either a solvent, e.g., MEK dewaxing operation or a catalytic dewaxing, preferably using a highly shape zeolite such as ZSM-22 or ZSM-23.

GENERAL PROCESS CONSIDERATION A LITERATURE REVIEW

Prior to catalytic dewaxing, the feed may be subjected to conventional processing steps such as solvent extraction to remove, if necessary, aromatics or to hydrotreating under conventional conditions to remove heteroatoms and possibly to effect some aromatics saturation or to solvent dewaxing to effect an initial removal of waxy components.

The catalytic dewaxing step operates by selectively removing the longer chain, waxy paraffins, mainly n-paraffins and slightly branched from the feed. Most processes of this type operate by selectively cracking the waxy paraffins to produce lower molecular weight products which may then be removed by distillation from the higher boiling lube stock. The catalysts which have been proposed for this purpose have usually been zeolites which have a pore size which admits the straight chain, waxy n-paraffins either alone or with slightly branched chain paraffins but which exclude the less waxy, more highly branched molecules and cycloaliphatics.

In general terms, catalytic dewaxing processes are operated under conditions of elevated temperature, usually ranging from about 260-425° C., depending upon the dewaxing severity necessary to achieve the target pour point for the product.

As the target pour point for the product decreases the severity of dewaxing process will be increased so as to effect an increasingly greater removal of parrafins with increasingly greater degrees of chain branching, so that lube yield will generally decrease with decreasing product pour point as successively greater amounts of feed are converted by selectivity cracking of the catalytic dewaxing to higher products boiling outside the lube boiling range. The V.I. of the product will also decrease at lower pour points as the high V.I. isoparaffins of relatively low degree of chain branching are progressively removed.

In addition the temperature is increased during each dewaxing cycle to compensate for decreasing catalytic activity. The dewaxing cycle normally is terminated when the temperature of about 357° C. is reached since product stability is too low at higher temperatures. The improvement in the oxidation stability of the product is especially notable at temperatures above about 330° C. with advantage over nickel containing catalyst. Hydrogen is not required stoichiometrically but promotes extended catalyst life by reduction in the rate of coke lay down on the catalyst (coke is highly carbonaceous hydrocarbon which tend to accumulate on the catalyst during the dewaxing process). The process is therefore carried out in the presence of hydrogen typically at 400-800 prig (about 2860 to 5620 $kP_a$). Hydrogen circulation rate is typically 1000 to 4000 SCF/bbl, usually 2000 to 3000 SCF/bbl of liquid feed.

Dewaxing Catalysts.

The dewaxing catalyst preferably comprises an intermediate pore size zeolite such as those having the structure of ZSM-5, ZSM-11, ZSM-23 or ZSM-35, which have structural silica: alumina ratio of at least 12:1 as well as a Constraint Index of 2 to 7. As described in U.S. Pat. Nos. 3,980,550, and 4,137,148. a metal hydrogenation component such as nickel was considered desirable for reducing catalyst aging. The use of these metals, especially nickel has, however, been found to have an adverse effect on the oxidation stability of the lube products and is not essential for extended cycle life or amenability to reaction with hydrogen. This is unexpected because the conventional view has been that although the metal component has not participated in the dewaxing mechanism as such (because dewaxing is essentially a shape selective cracking reaction which does not require the mediation of a hydrogenation-dehydrogenation function) it did contribute to the entire dewaxing process by promoting the removal of the coke by a process of hydrogen transfer to form volatile hydrocarbons which was removed at the temperature prevailing at the time. For the same reason, the metal component improved the hydrogen reactivation of the catalyst between successive dewaxing cycle as described in U.S. Pat. Nos. 3,956,102, 4,247,388, and 4,508,836.

The present dewaxing catalyst is based upon the findings that if $Ni/SiO_2$ catalyst converted to nano scale it will have improved product properties. The catalyst aging characteristics may be improved by the use of present nano catalyst. The improved amenability of catalyst to reactivation by hydrogen stripping could be achieved and it plays a vital role in removing the coke built up during the dewaxing process. It is believed that the improvements in aging rate and susceptibility to hydrogen reactivation which are associated with the use of nano catalyst may be attributed to the character of coke formed during the dewaxing. It is possible that at high temperatures prevailing at the end of the dewaxing cycle, the nickel/silica catalyst promotes dehydrogenation of the coke and convert to more hydrocarbon product, we believed that the present invention catalyst produces carbidic coke which could be finally converted to different hydrocarbon products as compared to other inventions where graphitic coke is produced which deactivates the catalyst. Similarly the characteristic of coke and other contaminants formed on the metal surface may be more readily desorbed resulting in improved hydrogen reactivation effects which are absent in others catalyst used for dewaxing processes.

SUMMARY OF THE INVENTION

An improved nano catalyst for dewaxing the heavy petroleum products ($>C_{23}$) have been developed and used in the dewaxing process. The dewaxing process comprising contact the heavy petroleum product with the nano catalyst and hydrogen in the autoclave (FIG. 4) and heating it up to 300° C. with the hydrogen pressure of 8-10 bar. The dewaxed effluent have a low melting/pour point (FIG. 4). The total nitrogen content of the dewaxed product is 65-300 ppm by weight thereby directly forming from said combined feed a dewaxed effluent containing high octane by product (FIG. 7 & Table 1).

TABLE 1

Untreated feed composition and Catalytic Dewaxing results at 30 bar hydrogen pressure

| Sr. No. | SAMPLE | Composition | Compound Name | % age | Fraction Type |
|---|---|---|---|---|---|
| 1 | Untreated feed | $n\text{-}C_{23}H_{48}$ | Tricosane | 94.951 | Medium Wax |
| | | $C_6H_6$ | Benzene | 5.049 | |
| 2 | Catalyst ($Ni/SiO_2$) treated (bulk) | $n\text{-}C_{19}H_{40}$ | Nonadecane | 94.994 | Lube Oil |
| | | $C_6H_6$ | Benzene | 5.006 | |
| 3 | Nano catalyst ($Ni/SiO_2$) treated | $n\text{-}C_{14}H_{30}$ | Tetradecane | 91.531 | Diesel |
| | | $n\text{-}C_{12}H_{26}$ | Dodecane | 3.463 | |
| | | $C_6H_6$ | Benzene | 4.426 | |

A preferred embodiment of the invention involves a dewaxing process providing lower molecular weight products with lower melting/pour point. The hydrocarbon feeds to be treated in accordance with the present invention include those petroleum fraction greater that $C_{23}$ while maintaining specification pour and cloud points.

A catalyst of present invention is a nano Ni/silica catalyst having surface area of more than 200 $m^2g^{-1}$ and a pore volume of 5.0 $A^0$ in maximum cross-sectional dimension.

DETAILED DESCRIPTION OF THE INVENTION

Figure 1:
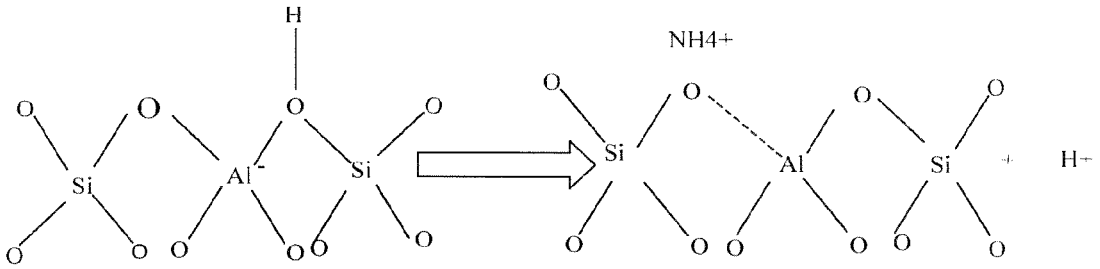
FIG. 1: Schematic representation of hydrogen ion replacement by ammonium ions FIG. 2 The experimental set up.
Figure 2:
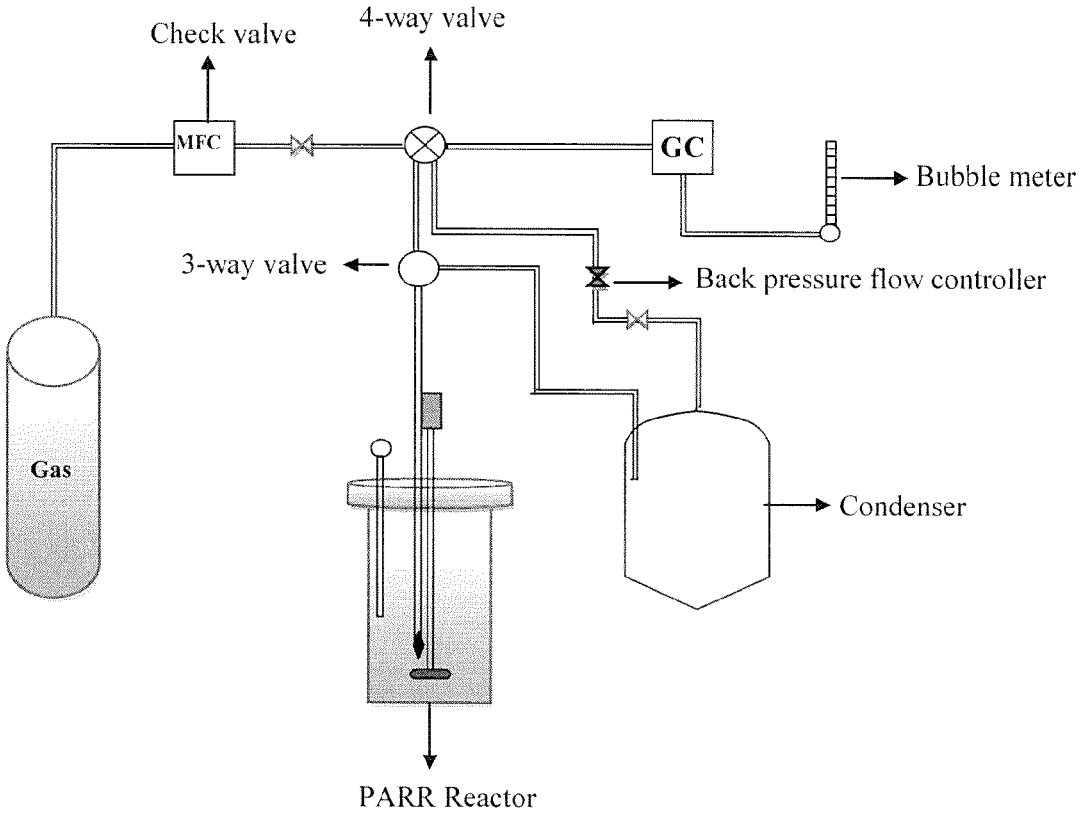
Figure 3:
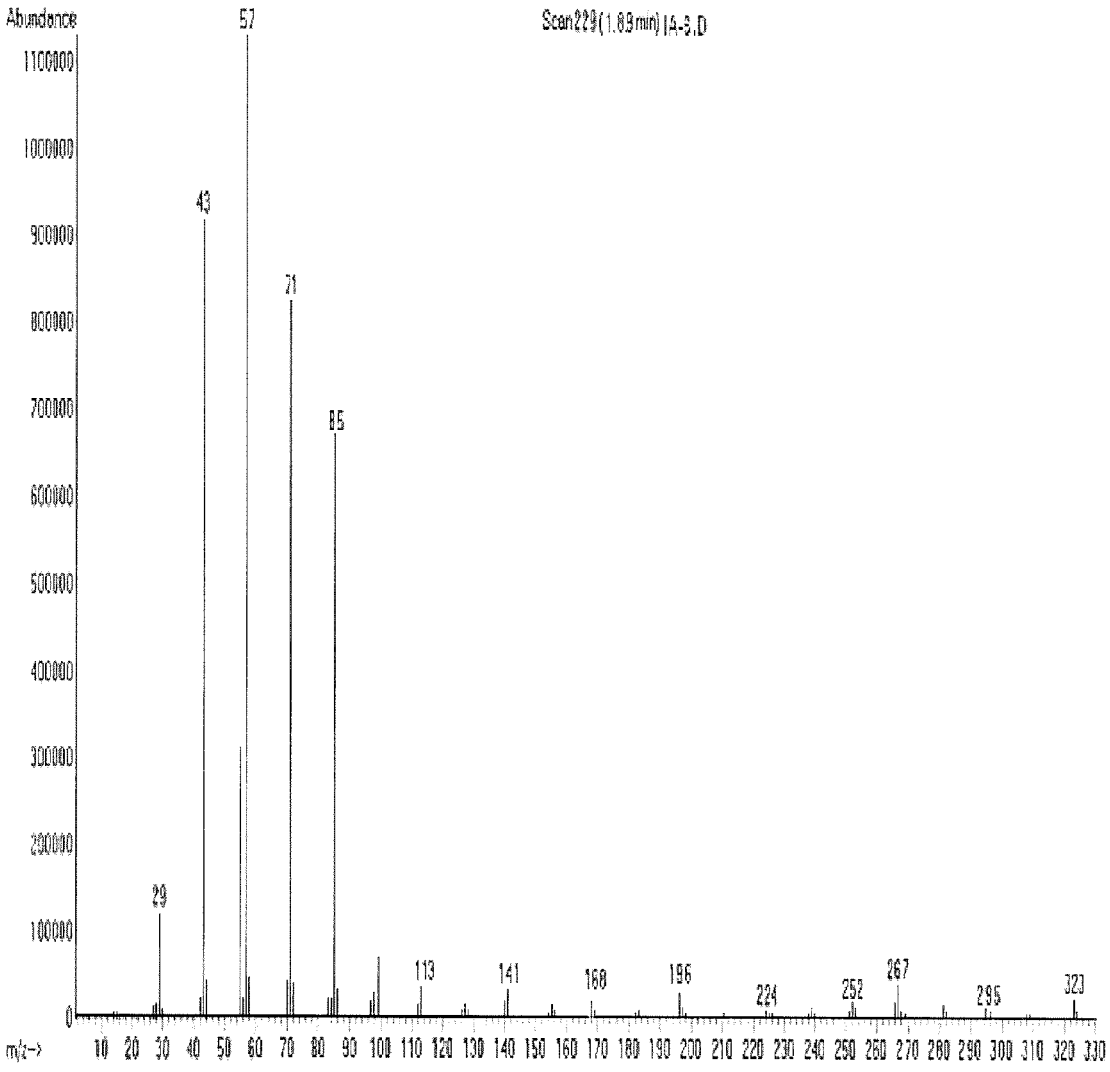
FIG. 3: as received petroleum waste) C-23 alkane.

The term dewaxing is employed herein to generally mean the removal of hydrocarbons which readily solidify from petroleum feed stocks as waxes.

The nano catalyst of the instant invention has been observed to convert alkanes in the hydrocarbon products and accordingly, reduce the pour point of such products, i.e. act as dewaxing catalyst. The reduction in the pour point/melting point by a selective normal paraffin conversion is of commercial significance since distillate products have a rigid specification on the acceptable pour product.

The catalyst employed in the instant invention are Ni dispersed on high surface area silica support and then converted it into nano range impart not only the high surface area but also large pore volume. The details of all catalysts used is presented in Table 2.

TABLE 2

Crystallite size calculated from XRD data.

| Catalysts | Average crystallite size Of fresh catalysts (nm) | Average crystallite size Of used catalysts (nm) |
|---|---|---|
| $Ni/SiO_2$ | 16.00 | 16.70 |
| NiMo/Zeolite | 32.00 | 32.80 |
| CoMo/Zeolite | 46.00 | 46.40 |
| Ni nanoparticles | 32.00 | 33.0 |

Dewaxing processes involve converting high boiling and high pour point waxes into lower boiling point and pour point products.

Pursuant to the particular features of the process and the nano catalyst of this invention, one type of useful reactor for the dewaxing process is essentially a vessel, preferably of cylindrical shape, wherein the dewaxing catalyst is dispersed. Feed stocks of $>C_{23}$ can be dewaxed accordingly to the process of the invention.

Typical dewaxing conditions includes contacting the feed stock with the dewaxing catalyst at about 300° C., and hydrogen is introduced to bring the vessel pressure to 8 bar. The gas product generated in the dewaxing process is collected at the outlet of the reactor which is maintained free open configuration so that hydrocarbon gas bubbling through the reactor can enhance the degasification process. The dewaxed product is withdrawn and tested using gas chromatography/mass spectrometery.

The catalyst used in the process of the present invention is a mixture of two components (1) a metal oxide (2) an amorphous porous inorganic oxides (silica). The weight percent of nickel is determined on the basis of amorphous porous silica. Preferably the metal is present in an amount ranging from 10 to 85 weight percent and more preferably 20 to 80 weight percent based on the finished catalyst composition or the finished catalyst mass. There are other methods in which nickel and other metals and porous inorganic component can be associated by impregnation or ion exchange. Impregnation is generally accomplished using an aqueous solution of a suitable nickel or other metal compounds. Either simultaneous or sequential impregnation of metal component is suitable. Ion exchange is generally accomplished by using an aqueous solution of nickel or other metal salts wherein the nickel or other metal salts are present in the cationic state. As an example in the preparation of catalyst wherein the carrier is an amorphous silica, the nickel and other metal salts are normally associated with silica by impregnation. Typical nickel and other metals compound which can be used for impregnation or ion exchange are the chlorides, nitrates, sulfates, acetates and amine complex or combination therein.

The nickel and other metal compounds can be associated with the amorphous inorganic oxides by co precipitation or cogelation of a mixture compounds of the hydrogenating metals and compounds of metals and/or nonmetals whose oxide form the amorphous porous inorganic oxide carrier. Hydrogenating components can be precipitated or cogelled with the compounds of the metals and or non metals whose oxides form the inorganic oxide carrier; or, the hydrogenating metals components can be associated with the amorphous porous inorganic oxide carrier by co-precipitation or cogelation, and the other hydrogenating metals components then intimately associated with the co-precipitated composite by impregnation or other suitable means. For example, a co-precipitated composite of nickel, cobalt, or any other metal compounds can be prepared by co-precipitating a mixture of nickel chloride, cobalt chloride with the porous inorganic oxides.

Following precipitation of the mixture of compounds by any method, the excess liquid is washed and ion exchanged to remove impurities. Washing is generally conducted in more then one step, using water or dilute aqueous solution of ammonium salts e.g., ammonium acetate. The copreciptated composite is then dried in air or inert gasses at a 450° C. for 4-5 hours.

As discussed above the catalyst mass used in the catalytic dewaxing process of the present invention is preferably composed of physical mixture of porous inorganic oxide and metal/metals oxide. The design catalyst prepared by hydrometallurgical methods has a particle size of 10-20 nms. Thus the catalyst mass of the present invention distinguishes from prior art dewaxing catalyst for several reasons, including the fact that nickel and other metals are not impregnated or ion exchanged onto porous inorganic oxide, but using U.S. patented method in which the surface geometry and particle size could be controlled by hydrogen pressure in the autoclave.

Synthesis Procedure

Synthesis of Catalysts on Zeolite and Silica Support

To synthesize catalysts on zeolite support, zeolites were first modified to increase acidic sites and surface area of the catalysts.

Modification of Zeolites

To increase the acid sites of the catalysts, zeolites were modified by ion exchange reaction. Calculated amount of zeolite was added to 0.5 M $NH_4NO_3$ solution (50 ml/g of zeolite) with constant stirring at 80° C. for about one hour. After repeating this procedure three times, the resulting material was filtered and washed with hot distilled water several times and then dried in air at 110° C. overnight and calcined at 550° C. for four hours.

Schematic representation of hydrogen ion replacement by ammonium ions

FIG. 1

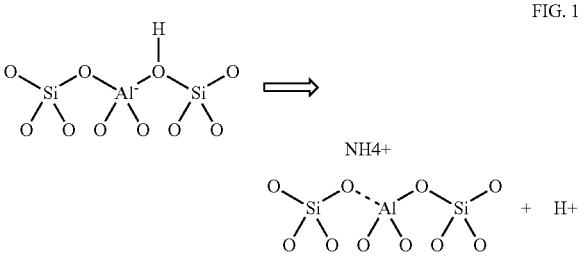

Example 1

Preparation of Catalysts on Zeolite/Silica Support

Zeolite/silica supported catalysts were synthesized by hydrothermal method. According to hydrothermal method, metals were loaded at the surface of support by reducing metal ions hydrothermally using metal salts along with $NH_4OH$ solution.

The solutions of metal salts were prepared in distilled water then zeolite/silica was added into metal salt solution. Metal salts used were in different proportions. The mixture was stirred for some time and then transferred into the autoclave. The autoclave was flushed with argon, and then pressurized to 10 bar or 250 psi. The reaction mixture was stirred at 160° C. under hydrogen pressure for one hour. The pressure was increased from 250 psi to 500 psi upon heating. Then, autoclave was cool down to room temperature and then resulting grey powder was washed with hot distilled water to remove ammonia and dried in air at 110° C. for almost 12 hours and then calcined at 600° C. for six hours.

Example 2

Synthesis of Co—Mo/Zeolite

To synthesize catalyst containing cobalt and molybdenum supported on zeolite, first of all solution was prepared by dissolving 2.46 g cobalt nitrate hexahydrate and 1.84 g ammonium molybdate tetrahydrate in distilled water, then zeolite support was added to it, stirred and transferred into a vessel of autoclave. A solution of 0.5 M $NH_4OH$ was added to it. The reaction vessel was flushed with argon and then pressure was kept constant at 250 psi. The reaction mixture was stirred for one hour at 160° C. and then cooled to room temperature. The resulting powder was washed many times with hot distilled water dried at 110'C overnight and calcined at 600° C. for 6 hours.

Example 3

Synthesis of Ni—Mo/Zeolite

To synthesize catalyst containing nickel and molybdenum supported on zeolite, first of all solution was prepared by dissolving 2.51 g nickel nitrate hexahydrate and 1.84 g ammonium molybdate tetrahydrate in distilled water, then zeolite support was added to it, stirred and transferred into a vessel of autoclave. A solution of 0.5 M $NH_4OH$ was added to it. The reaction vessel was flushed with argon and then pressure was kept constant at 250 psi. The reaction mixture was stirred for one hour at 160° C. and then cooled to room temperature. The resulting powder was washed with hot distilled water for many times and dried in air at 110° C. overnight and calcined at 600° C. for 6 hours.

Example 4

Synthesis of $Ni/SiO_2$ Catalyst

To synthesize catalyst containing nickel supported on silica, first of all solution was prepared by dissolving 6.171 g $Ni(NO_3)_2.6H_2O$ in distilled water, then silica support was added to it, stirred and transferred into a vessel of autoclave. A solution of 0.5 M $NH_4OH$ was added to it. The reaction vessel was flushed with argon and then pressure was kept constant at 250 psi. The reaction mixture was stirred for one hour at 160° C. and then cooled to room temperature. The resulting powder was washed with hot distilled water for many times and dried in air at 110° C. overnight and calcined at 600° C. for 6 hours.

Example 5

Synthesis of Ni Nano Particles

Nickel nanoparticles were synthesized by co-precipitation method. nickel nitrate solution was prepared by dissolving 24.78 g of Ni $(NO_3)_2.6H_2O$ in distilled water, 2-3 ml of nitric acid was added to it. A solution of 1M KOH was drop wise added to it with constant stirring. When pH rises to 12, addition of KOH was stopped and further stirred for half an hour, and then precipitates were washed with hot distilled water several times and then dried in an oven overnight at 110° C. and calcined in air at 550° C. for 6 hours. The resulting metal oxides were reduced to metal nanoparticles at 450° C. by passing $H_2$ gas through the sample loaded in the tube furnace.

Figure 4:
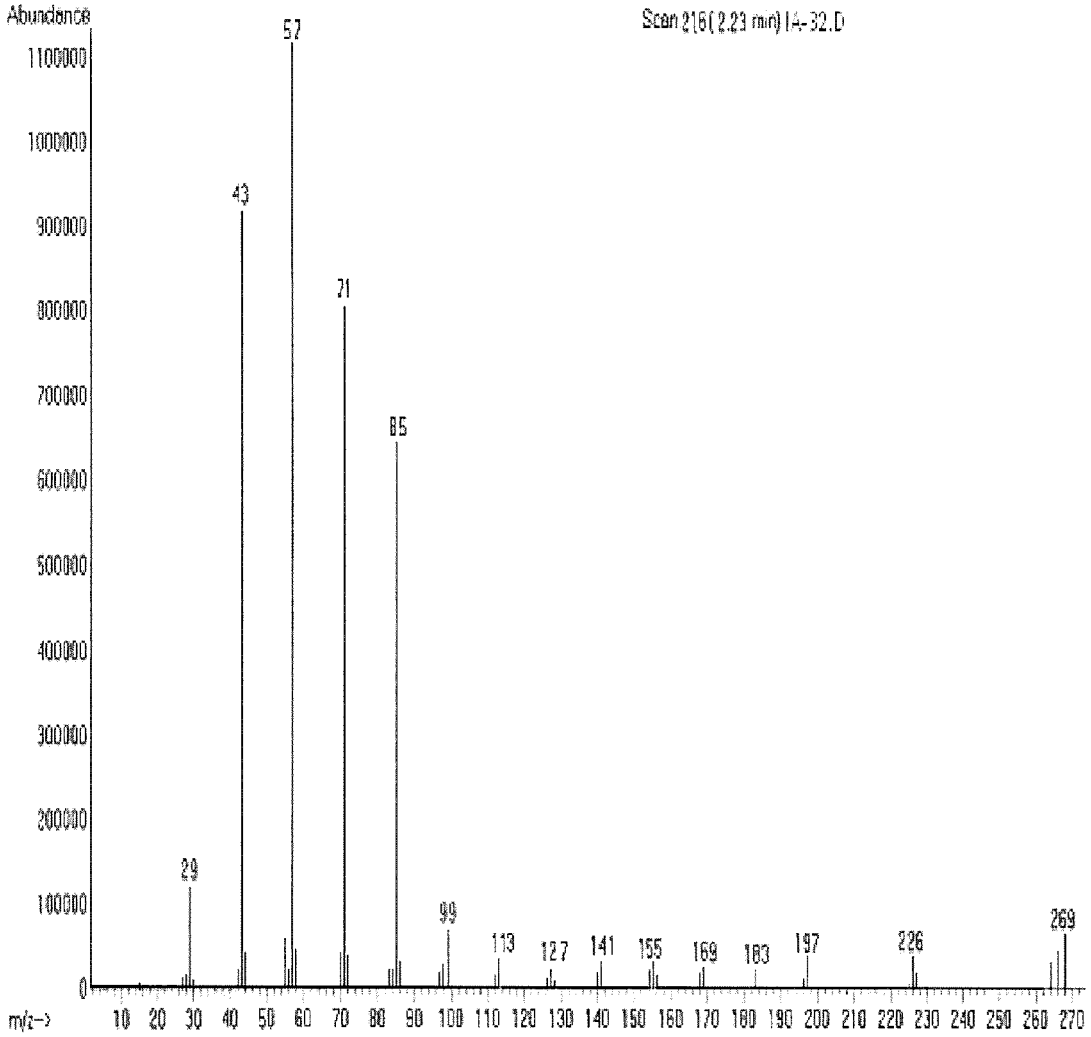
FIG. 4: catalytic treated product at 8 bar hydrogen pressure (C-19 alkane) & table 4.
Figure 5:
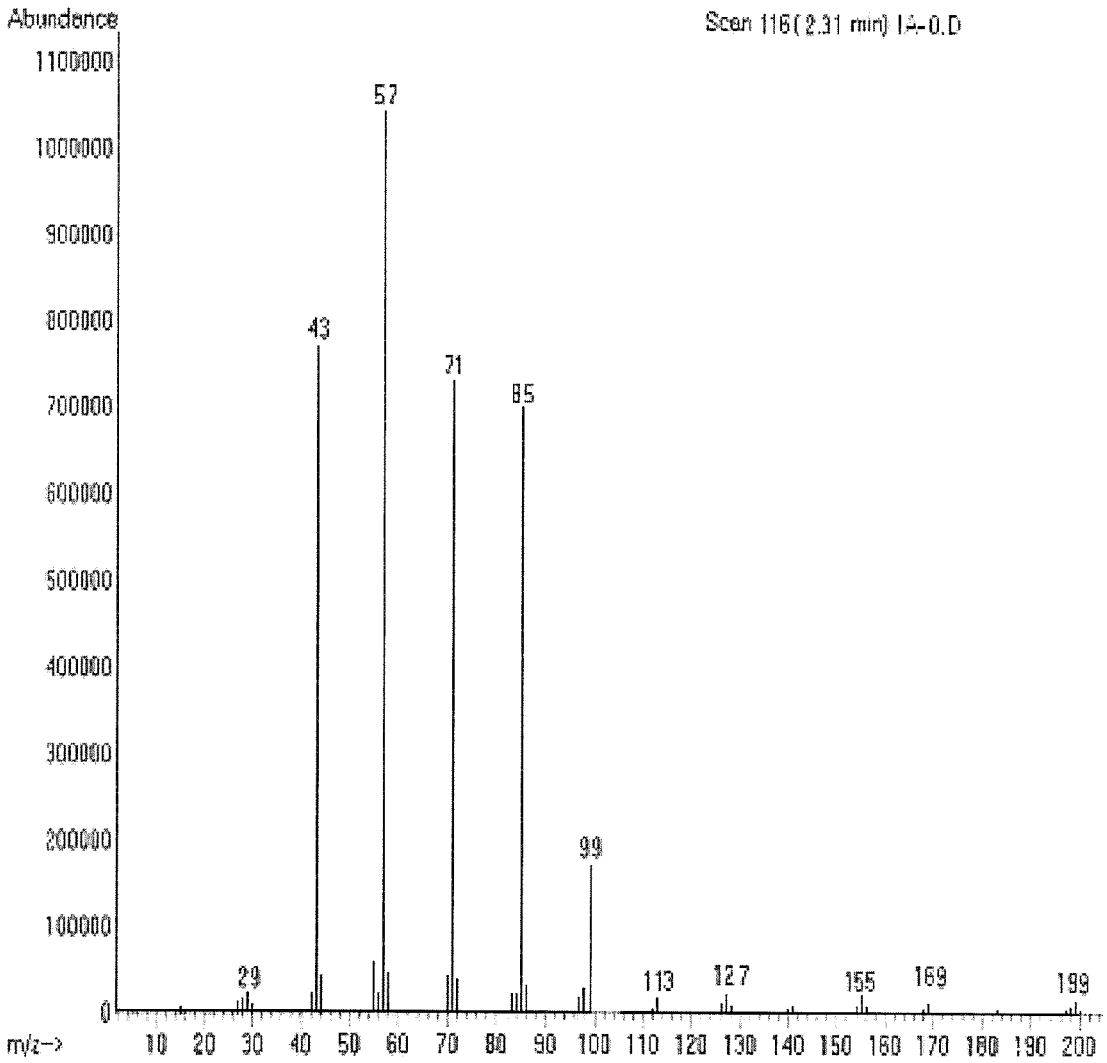
FIG. 5: catalytic treated product at 30 bar hydrogen pressure (C-14 n-alkane) & table 1 & 3.
Figure 6:
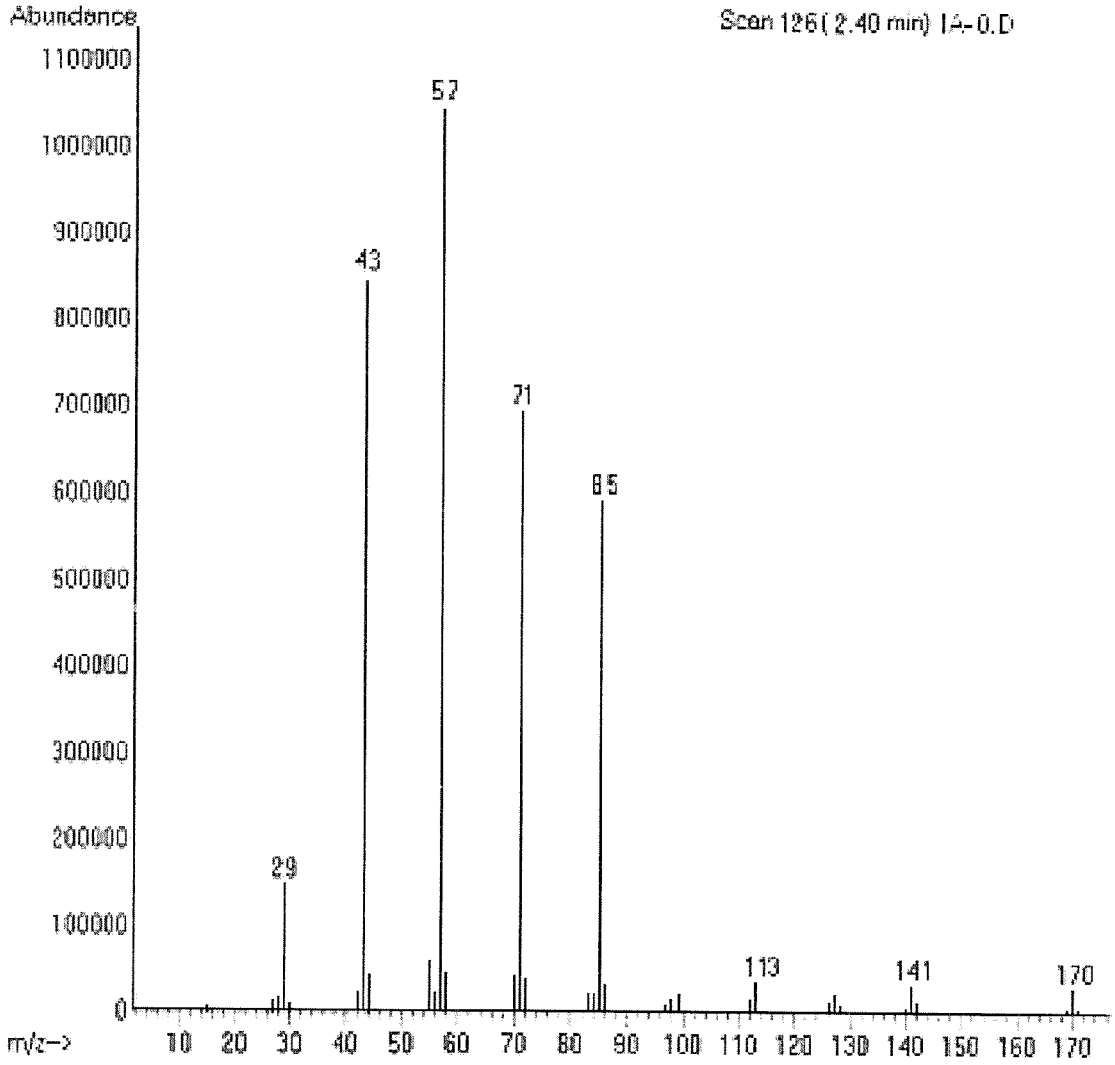
FIG. 6: catalytic treated products at 30 bar hydrogen pressure (C-12 alkanes)
Figure 7:
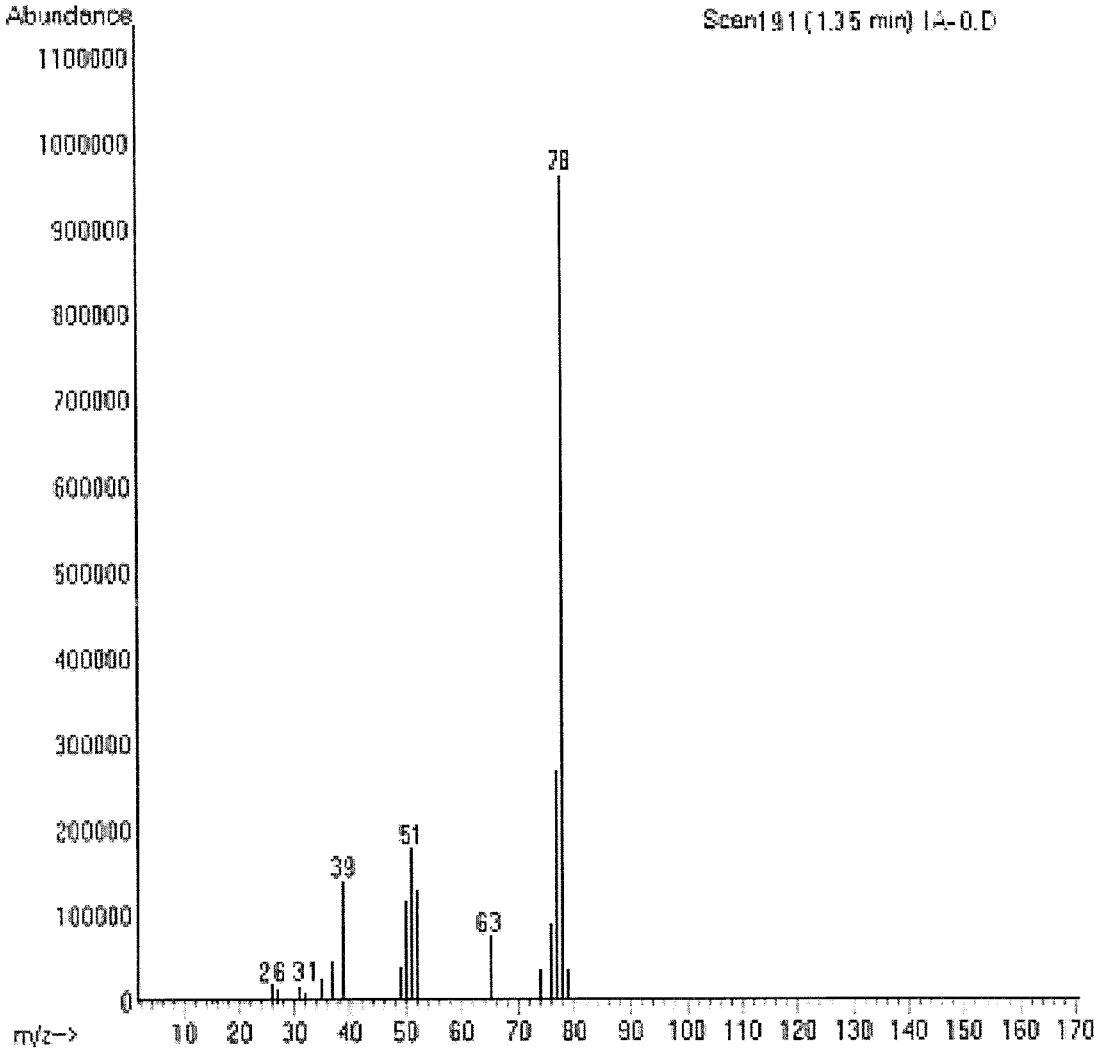
FIG. 7: catalytic treated product at 30 bar hydrogen pressure benzene
Figure 8:
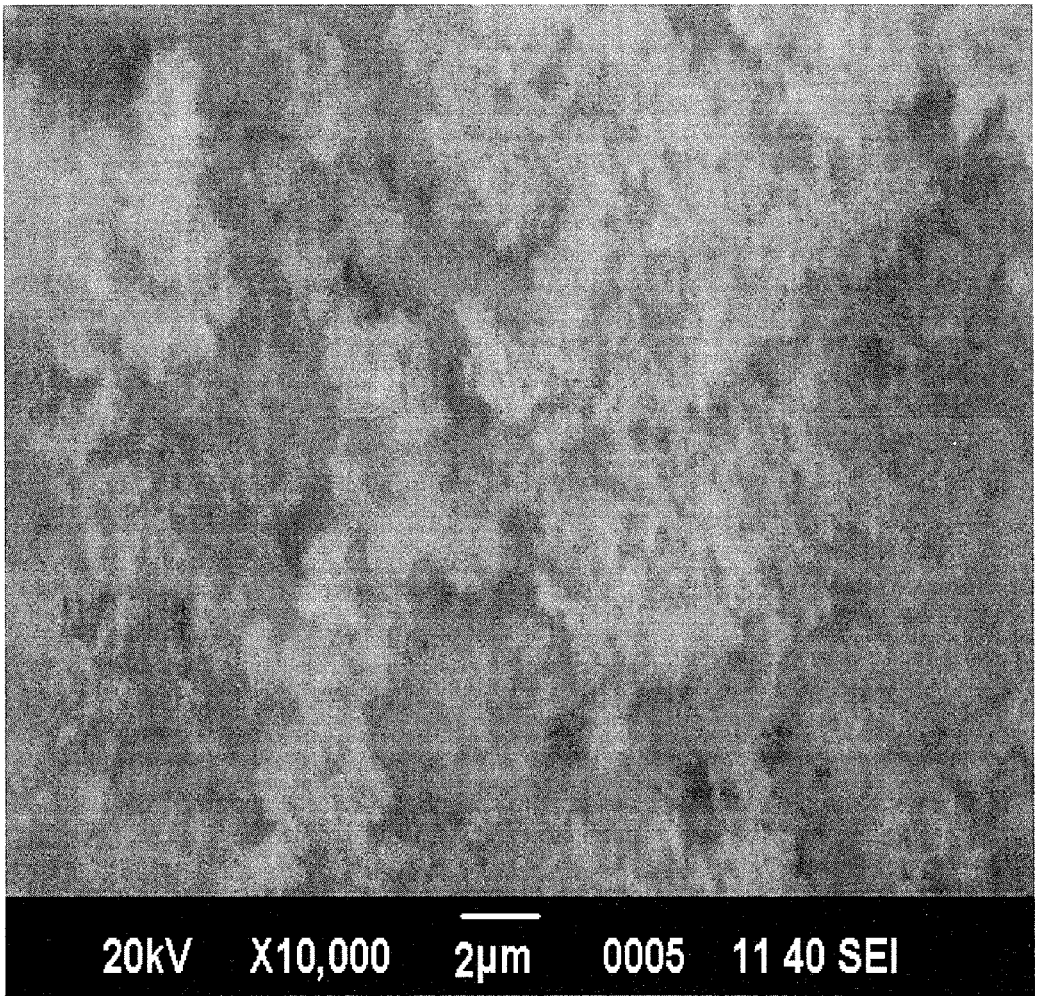
FIG. 8: SEM of Ni:Mo/zeolite
Figure 9:
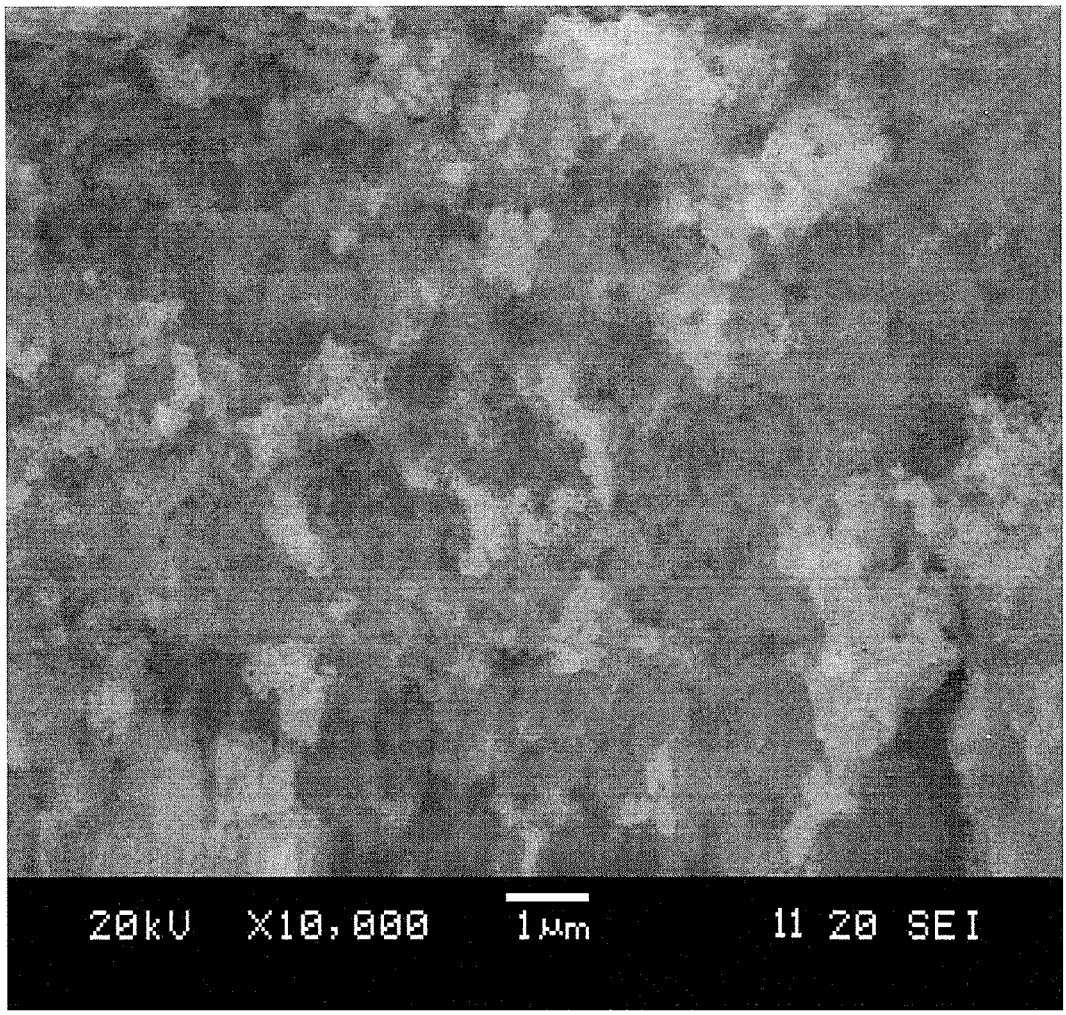
FIG. 9: SEM Ni:Mo/Zeolite catalyst
Figure 10:
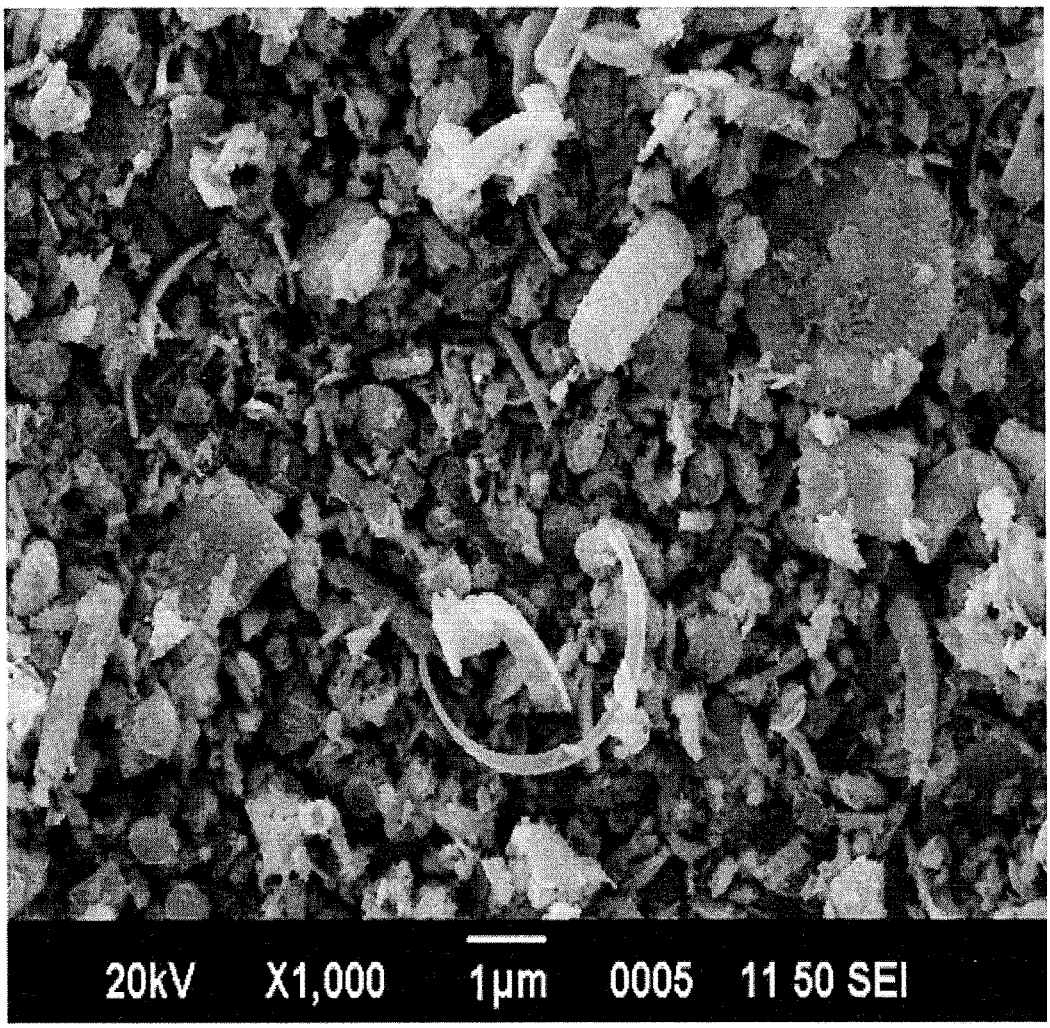
FIG. 10: SEM Ni nano particles
Figure 11:
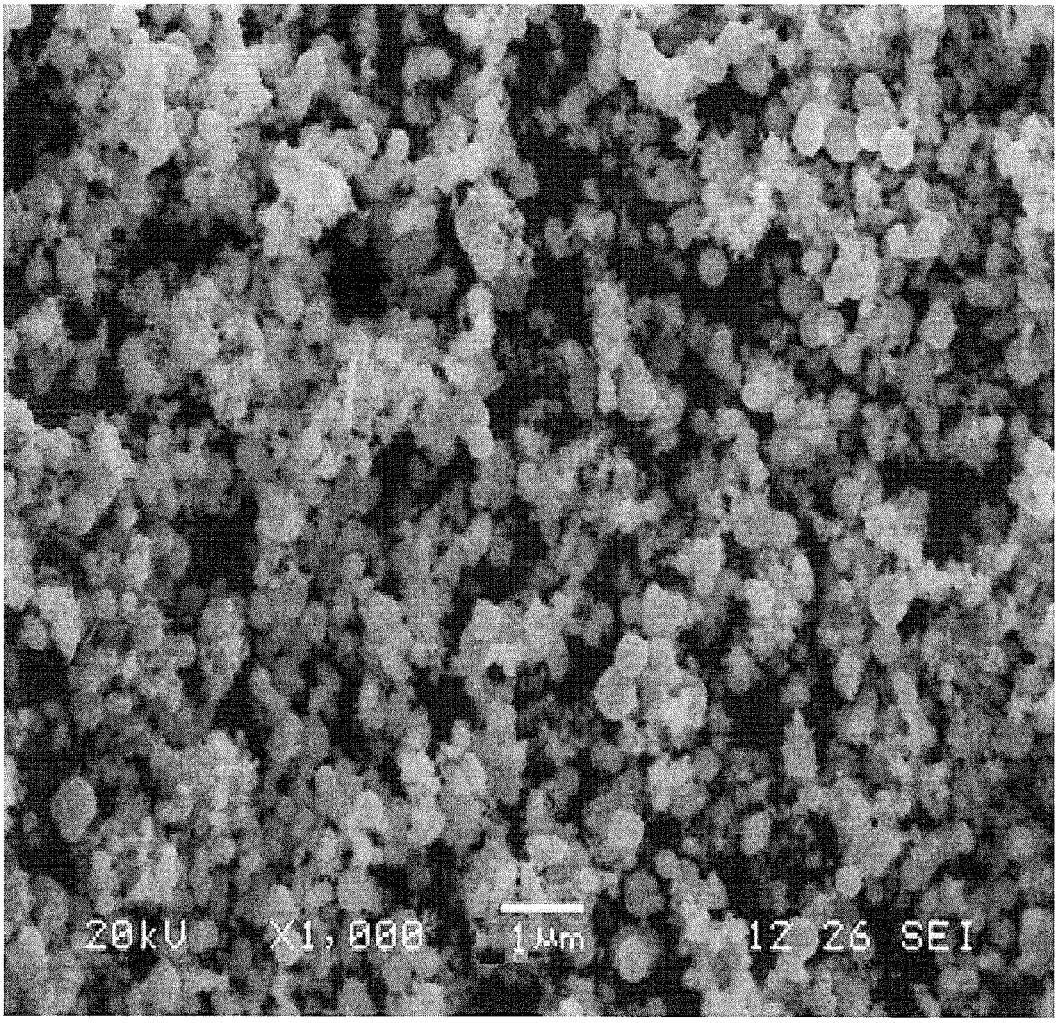
FIG. 11: SEM Ni/silica catalyst
Figure 12:
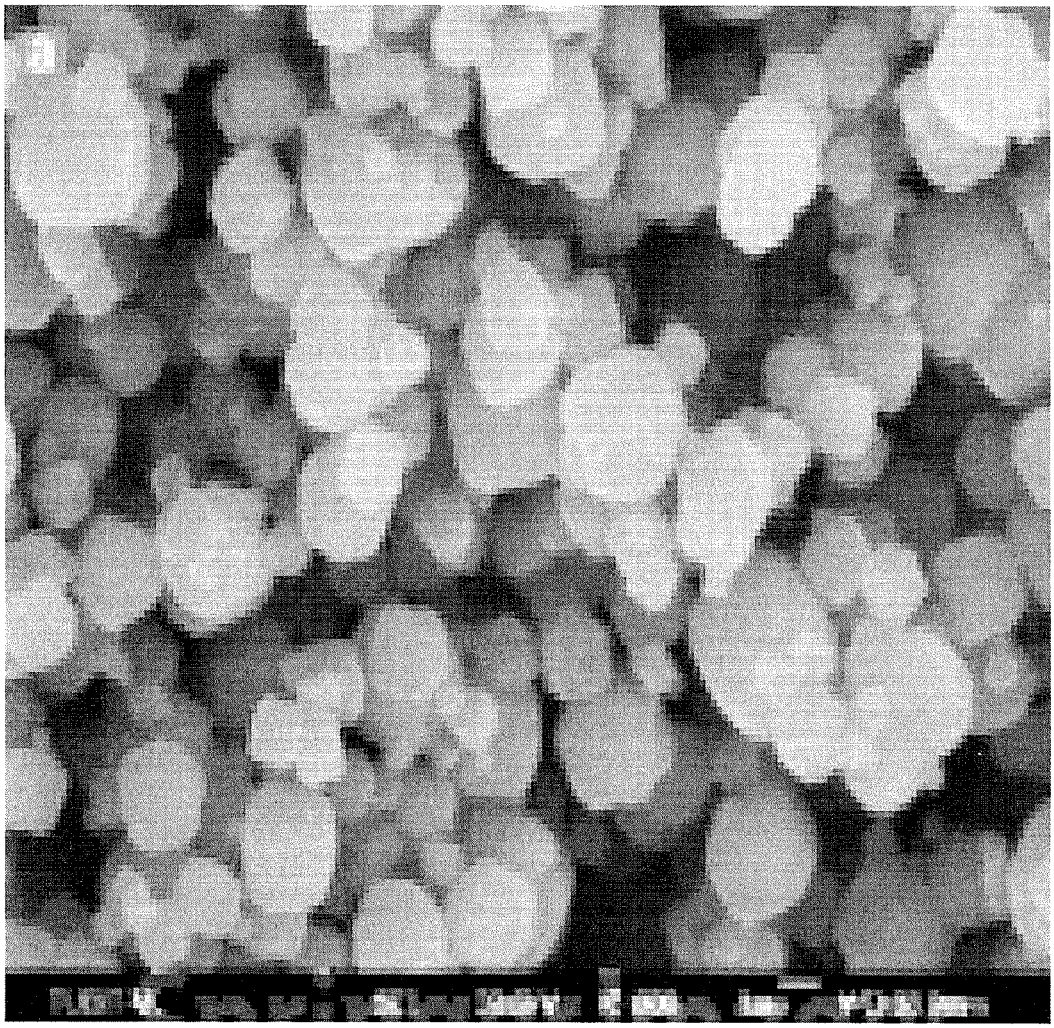
FIG. 12: SEM of commercial zeolite
Figure 13:
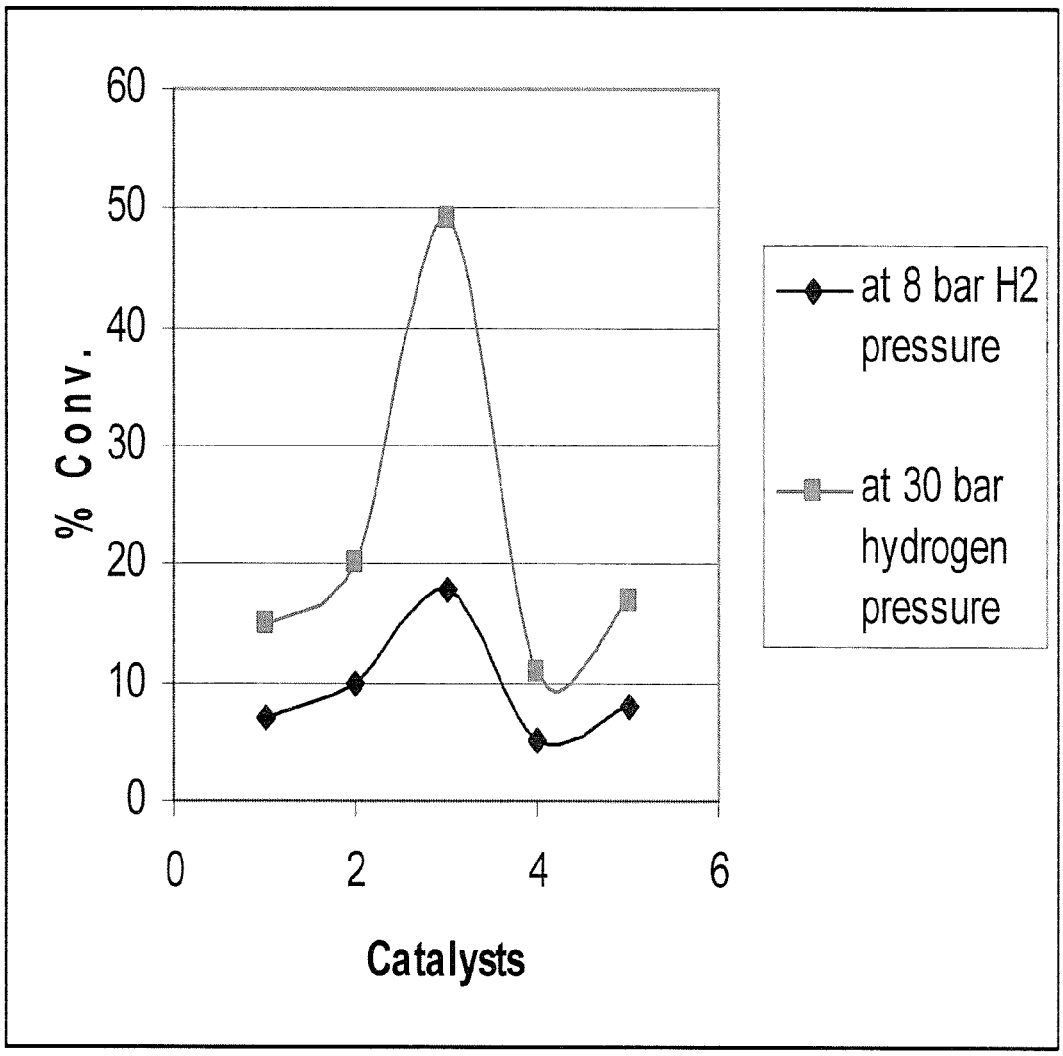
FIG. 13: Catalytic Conversion data at 8 and 30 bar hydrogen pressure

A suitable amount of the waxy feed was placed in the reaction vessel and 1-2 g of the catalyst was added to it. After closing the reaction vessel, the temperature was increased to 60° C. and argon gas flushed through the reaction vessel. Then pressurized the reaction mixture with $H_2$ gas about 8 bar in one experiment and to 30 bar in another experiment. The reaction mixture was stirred at 15 rpm for 30-50 minutes under $H_2$ pressure at desired temperature. After cooling to room temperature, liquid fuel was separated while that remains solid was compared with original feed by melting point determination and characterized by GC-MS. The petroleum feed used in the study have melting point of 49° C. The catalytic activity measurement is schematically explained in FIGS. 4, 5, 6 and 7 and Tables 3 and 4.

TABLE 3

Effect on Product Melting Point at 30 bar hydrogen pressure on different catalysts

| Sr. No | Reaction Temperature (° C.) | CoMo/ zeolite treated M.P ° C. | NiMo/ zeolite treated M.P ° C. | $Ni/SiO_2$ Treated M.P ° C. | Ni nano-particles Treated M.P ° C. | Commercial catalyst (ZSM-5) treated M.P ° C. |
|---|---|---|---|---|---|---|
| 1 | 200 | 47 | 44 | 40 | 46 | 46 |
| 2 | 250 | 38 | 40 | 32 | 42 | 39 |
| 3 | 300 | 35 | 37 | 22 | 40 | 30 |
| 4 | 350 | 32 | 33 | 18 | 39 | 28 |

TABLE 4

Effect on Product Melting Point at 8 bar hydrogen pressure on different catalysts

| Sr. No | Reaction Temperature (° C.) | CoMo/ zeolite treated M.P ° C. | NiMo/ zeolite treated M.P ° C. | $Ni/SiO_2$ Treated M.P ° C. | Ni nano-particles Treated M.P ° C. | Commercial catalyst (ZSM-5) treated M.P ° C. |
|---|---|---|---|---|---|---|
| 1 | 200 | 47 | 44 | 42 | 46 | 46 |
| 2 | 250 | 46 | 42 | 41 | 45 | 44 |
| 3 | 300 | 44 | 40 | 38 | 43 | 43 |
| 4 | 350 | 43 | 38 | 36 | 41 | 41 |

The invention claimed is:

1. A process for dewaxing a heavy wax feed stock consisting of hydrocarbons with higher than 23 carbons comprising:

mixing the feed stock with a nickel-silica nano catalyst in an autoclave;

heating the autoclave to a temperature of 160° C. while flushing with argon gas;

pressurizing the autoclave with hydrogen gas to provide a pressure of 8 to 30 bar; and, continuous mixing the mixture for 30-50 minutes at 100 rotation per minute, cooling to room temperature and separating the solid and liquids in the autoclave.

2. The process according to claim 1 wherein the particles size of nickel-silica catalyst is 15 nms.

3. The process according to claim 1 wherein the surface area of nickel-silica catalyst 450 $m^2g^{-1}$.

4. The process according to claim 1 wherein in the pore size of the catalyst is 4.0-6.5 mls/gms.

5. The process according to claim 1 wherein the catalyst contains different oxidation states of nickel.

6. The process according to claim 1 wherein the silica has bronsted acid sites ranging from 0.8-2 mls/g catalyst.

7. The process according to claim 1 wherein Ni is replaced by Co and Mo.

8. The process according to claim 1 wherein Ni is replaced by Ni:Mo.

9. The process according to claim 1 wherein the nano catalyst amount varies from 0.5% to 0.8% of the total feed-stock.

10. The process according to claim 1 wherein the feedstock comprises hydrocarbons and waxes is selected from the group consisting of fuels, oils, jet fuels, lube oils, naptha, reformate, and products of Fischer Trospsch reaction.

11. The catalyst according to claim 1 where the ratio between the nickel and silica is between 1:10.

12. The catalyst according to claim 1 wherein the silica is replaced by zeolite.

* * * * *